US011062549B2

(12) United States Patent
Jadeja

(10) Patent No.: US 11,062,549 B2
(45) Date of Patent: Jul. 13, 2021

(54) GAMING MACHINES, SYSTEMS, AND METHODS WITH CONFIGURABLE BUTTON DECK INCLUDING A DYNAMIC LOW PROFILE PUSHBUTTON ASSEMBLY

(71) Applicant: ARISTOCRAT TECHNOLOGIES AUSTRALIA PTY LIMITED, North Ryde (AU)

(72) Inventor: Rajendrasinh Banesinh Jadeja, Las Vegas, NV (US)

(73) Assignee: Aristocrat Technologies Australia Pty Limited, North Ryde (AU)

( * ) Notice: Subject to any disclaimer, the term of this patent is extended or adjusted under 35 U.S.C. 154(b) by 56 days.

(21) Appl. No.: 16/688,291

(22) Filed: Nov. 19, 2019

(65) Prior Publication Data

US 2020/0082661 A1 Mar. 12, 2020

Related U.S. Application Data

(63) Continuation of application No. 16/665,997, filed on Oct. 28, 2019, and a continuation of application No. 16/665,981, filed on Oct. 28, 2019, which is a continuation of application No. 16/584,532, filed on Sep. 26, 2019, now Pat. No. 10,878,652, said application No. 16/665,997 is a continuation of application No. 16/584,532, filed on Sep. 26, 2019, now Pat. No. 10,878,652, which is a continuation of application No. 15/686,688, filed on Aug. 25, 2017, now Pat. No. 10,431,037.

(51) Int. Cl.
*G07F 17/32* (2006.01)

(52) U.S. Cl.
CPC ..... *G07F 17/3209* (2013.01); *G07F 17/3211* (2013.01); *G07F 17/3216* (2013.01)

(58) Field of Classification Search
CPC ..... G07F 17/3209; G07F 17/3211; G07F 17/3216
USPC ..... 463/37
See application file for complete search history.

(56) References Cited

U.S. PATENT DOCUMENTS

| | | | |
|---|---|---|---|
| D463,828 | S | 10/2002 | Johnson |
| 8,137,181 | B2 | 3/2012 | Bleich |
| 8,262,480 | B2 | 9/2012 | Cohen et al. |

(Continued)

OTHER PUBLICATIONS

Office Action dated Jul. 14, 2020 for U.S. Appl. No. 16/584,532 (pp. 1-6).

(Continued)

*Primary Examiner* — Allen Chan
(74) *Attorney, Agent, or Firm* — Armstrong Teasdale LLP

(57) ABSTRACT

Gaming machines, methods, and systems include a dynamically configurable pushbutton assembly including a video display having a first top surface and a first outer periphery defining a display screen area. At least one mechanical pushbutton is mounted to the display screen, the at least one mechanical pushbutton includes a second top surface and a second outer periphery defining a corresponding pushbutton area within. The second top surface and the pushbutton area are located to extend at least partly over a portion of the display screen area and within the first outer periphery, and the second top surface is transparent so that the portion of display screen area within the pushbutton area is visible through the second top surface.

20 Claims, 10 Drawing Sheets

(56) References Cited

U.S. PATENT DOCUMENTS

| | | | | |
|---|---|---|---|---|
| 9,558,614 | B2 | 1/2017 | Lind et al. | |
| 10,210,698 | B2 | 2/2019 | Sumi et al. | |
| 2004/0038721 | A1 | 2/2004 | Wells | |
| 2007/0060291 | A1 | 3/2007 | Cole et al. | |
| 2007/0155511 | A1 | 7/2007 | Grundstedt et al. | |
| 2008/0113766 | A1* | 5/2008 | Waxman | H01H 13/7057 463/25 |
| 2009/0131168 | A1* | 5/2009 | Waxman | H01H 13/06 463/36 |
| 2010/0026635 | A1 | 2/2010 | Dimitrov et al. | |
| 2010/0120534 | A1 | 5/2010 | Borissov et al. | |
| 2011/0111852 | A1* | 5/2011 | Cohen | G07F 17/32 463/37 |
| 2012/0178528 | A1 | 7/2012 | Brunell et al. | |
| 2015/0206400 | A1 | 7/2015 | Berman | |
| 2019/0066433 | A1 | 2/2019 | Jadeja | |

OTHER PUBLICATIONS

Notice of Allowance dated Oct. 7, 2020 for U.S. Appl. No. 16/584,532 (pp. 1-7).

Office Action dated Feb. 25, 2021 for U.S. Appl. No. 16/665,981 (pp. 1-11).

Office Action dated Mar. 1, 2021 for U.S. Appl. No. 16/665,997 (pp. 1-12).

Office Action dated Mar. 17, 2021 for U.S. Appl. No. 16/688,345 (pp. 1-11).

Office Action dated Mar. 19, 2021 for U.S. Appl. No. 16/688,396 (pp. 1-12).

Notice of Allowance dated May 19, 2021 for U.S. Appl. No. 16/66597 (pp. 1-7).

Notice of Allowance dated May 24, 2021 for U.S. Appl. No. 16/665,981 (pp. 1-8).

* cited by examiner

GAMING MACHINES, SYSTEMS, AND METHODS WITH CONFIGURABLE BUTTON DECK INCLUDING A DYNAMIC LOW PROFILE PUSHBUTTON ASSEMBLY

CROSS REFERENCE TO RELATED APPLICATIONS

This application claims priority to and is a continuation of U.S. Patent Application, filed on Nov. 19, 2019, entitled "GAMING MACHINES, SYSTEMS, AND METHODS WITH CONFIGURABLE BUTTON DECK INCLUDING A DYNAMIC LOW PROFILE PUSHBUTTON ASSEMBLY," U.S. Patent Application, filed on Nov. 19, 2019, entitled "GAMING MACHINES, SYSTEMS, AND METHODS WITH CONFIGURABLE BUTTON DECK INCLUDING A DYNAMIC LOW PROFILE PUSHBUTTON ASSEMBLY," U.S. patent application Ser. No. 16/665,997, filed on Oct. 28, 2019, entitled "GAMING MACHINES, SYSTEMS, AND METHODS WITH CONFIGURABLE BUTTON DECK INCLUDING A DYNAMIC LOW PROFILE PUSHBUTTON ASSEMBLY,", and U.S. patent application Ser. No. 16/665,981, filed on Oct. 28, 2019, entitled "GAMING MACHINES, SYSTEMS, AND METHODS WITH CONFIGURABLE BUTTON DECK INCLUDING A DYNAMIC LOW PROFILE PUSHBUTTON ASSEMBLY,", which are both continuations of U.S. patent application Ser. No. 16/584,532, filed on Sep. 26, 2019, entitled "GAMING MACHINES, SYSTEMS, AND METHODS WITH CONFIGURABLE BUTTON DECK INCLUDING A DYNAMIC LOW PROFILE PUSHBUTTON ASSEMBLY,", which is a continuation of U.S. patent application Ser. No. 15/686,688, filed on Aug. 25, 2017, issued as U.S. Pat. No. 10,431,037 on Oct. 1, 2019, entitled "GAMING MACHINES, SYSTEMS, AND METHODS WITH CONFIGURABLE BUTTON DECK INCLUDING A DYNAMIC LOW PROFILE PUSHBUTTON ASSEMBLY,", which are all hereby incorporated herein by reference in their entireties.

BACKGROUND OF THE INVENTION

The embodiments described herein relate generally to gaming machines and, more particularly, to gaming machines, systems, and methods including a configurable button deck with dynamically configurable, low profile pushbutton assemblies.

With advancements in graphics processors, multiple video displays are becoming more common in gaming machines. For example, a gaming machine may include a main game display and at least one secondary display coordinated by a game controller to provide a more immersive gaming experience. The secondary display may be associated with a player interface that enables the player to communicate with the gaming machine. Using the player interface, the player can make wagers, enable pay lines, cash-out accumulated credits, prompt a play of the game or make inter-game selections in a game of chance. Accordingly, the player interface typically includes a bill/card/voucher acceptor for accepting and/or validating cash bills, coupons, and ticket vouchers in order to play the game. These bill/card/voucher acceptors may also be enabled to accept player identification cards used in rewards/loyalty programs through which players are enrolled to obtain promotions. These promotions may be things such as gifts, meals or cash back to the player based upon the players wagering activities tracked via presentment of the player identification card. The player interface may also include a credit or cash-out element for the player to collect any winnings from games played.

For game play itself, the player interfaces of gaming machines typically include a number of mechanical pushbuttons for manual activation by a player to select game preferences, activate a game sequence, or otherwise provide input to the machine. The mechanical pushbuttons are typically arranged in combination on a surface of the gaming machine cabinet that is often referred to as a "button deck". As conventionally applied, the button deck and each mechanical pushbutton included in the button deck tend to be customized for each gaming machine, and as the number of mechanical pushbuttons rises in any given button deck, cost and reliability issues are presented to game manufacturers and/or maintenance issues to operators of gaming facilities.

Also, conventional mechanical pushbuttons provide practical limitations to the graphical design themes on a gaming machine, and also provide limited user interaction. As conventionally implemented, mechanical pushbuttons are static (i.e., non-changing) in color, appearance or function in the game play, as well as static when the game is not being played. The static pushbuttons provide practical limitations on the ability to reconfigure the interface for use with another game, or to enhance the graphics of the game during play, or the gaming machine in general, to attract a player. Improvements are desired.

SUMMARY OF THE INVENTION

An embodiment described herein provides a dynamically configurable pushbutton assembly including a video display having a front surface and a first outer periphery defining a display screen area, and at least one mechanical pushbutton coupled to the display screen, the at least one mechanical pushbutton including a second top surface and a second outer periphery defining a corresponding pushbutton area within that is substantially smaller than the display screen area. The second top surface and the pushbutton area are located to extend at least partly over a first portion of the display screen area within the first outer periphery, and the second top surface is transparent so that the first portion of display screen area within the pushbutton area is visible through the second top surface. A second portion of the display screen area extends outside the second outer periphery and in combination with the at least one mechanical pushbutton defines a user interface.

Optionally, further embodiments of a dynamically configurable pushbutton assembly described herein may include the at least one mechanical pushbutton is mechanically isolated from the front surface of the video display. The assembly may include a support plate extending in spaced relation from the front surface of the video display, and the at least one mechanical pushbutton coupled to the support plate. The support plate may include an opening, and the at least one mechanical pushbutton may be received in the opening. The assembly may also include a gasket having an opening that receives the at least one mechanical pushbutton.

Further embodiments of a dynamically configurable pushbutton assembly described herein may include the at least one mechanical pushbutton having a bezel surrounding at least a portion of the second outer periphery. The bezel may include a lighting element, and the lighting element may be operable to display a plurality of different colors. The lighting element may be a light emitting diode (LED) element.

Embodiments of a dynamically configurable pushbutton assembly described herein may also include an insulator and a capacitive touch screen layer overlying the front surface of the video display. The insulator and the capacitive touch screen layer may each include an opening, and a portion of the mechanical pushbutton may be received in the opening. The video display may be a liquid crystal display (LCD). The second top surface and pushbutton area may be located to extend entirely over the first portion of the display screen area. The at least one mechanical pushbutton may include a plurality of pushbuttons, with the video display and the plurality of pushbuttons in communication with a game controller and in combination defining a button deck for a gaming machine.

Another embodiment described herein provides a gaming machine having a game interface including a video display having a front surface and a first outer periphery. The video display is at least partly provided with an insulator and a capacitive touch sensitive element within the first outer periphery. Each of the insulator and the capacitive touch sensitive element include an opening extending therethrough. At least one mechanical pushbutton is received at least partially in the opening and mounted in spaced relation to the front surface. The at least one mechanical pushbutton includes a second top surface and a second outer periphery defining a corresponding pushbutton area within. The second top surface and button area are located to extend at least partly over portion of the video display. The second top surface is transparent, and a game controller is connected to the touch screen and to the at least one mechanical pushbutton. The game controller is configured to generate a desired display including a display portion within the button area on at least the portion of the video display, whereby the display portion is visible through the second top surface.

Optionally, further embodiments of a gaming machine described herein may include a support plate, with the at least one mechanical pushbutton coupled to the support plate. The support plate may overlie the front surface of the video display. At least one wire may connect the at least one mechanical pushbutton and the controller, and the wire may extend between the support plate and the insulator.

Further embodiments of a gaming machine described herein may include the at least one mechanical pushbutton further having a bezel surrounding at least a portion of the second outer periphery. The bezel may include a lighting element. The lighting element may be operable to display a plurality of different colors. The lighting element may be a light emitting diode (LED) element.

Embodiments of a gaming machine described herein may further include the video display being a liquid crystal display (LCD). The second top surface and pushbutton area may be located to extend entirely over a portion of the touch screen area. The at least one mechanical pushbutton may include a plurality of mechanical pushbuttons, the touch screen and plurality of mechanical pushbuttons in combination defining a button deck on the gaming machine. The machine may further include at least one of a coin acceptor, a credit element, or a cash out element. The machine may also include a main screen, with the game controller being responsive to at least one mechanical pushbutton to activate a game sequence on the main screen.

Another embodiment described herein provides a method of configuring a player interface in a gaming machine system including at least one video display having a front surface defining a display screen area and a mechanical pushbutton assembly at least partly overlying the display screen area. The mechanical pushbutton assembly includes a transparent top surface and a pushbutton area substantially smaller than the display screen area. The method is implemented with a controller and includes: dynamically generating a game interface including a unique image on the display screen area that is visible through the transparent top surface of the mechanical pushbutton assembly and the pushbutton area to render the pushbutton assembly visually prominent relative to a reminder of the display screen area.

Further embodiments of a method of configuring a player interface in a gaming machine system described herein may further include the mechanical pushbutton having a lighting element, and the method may include dynamically operating the lighting element in the mechanical pushbutton assembly, in combination with the unique image to present a first game interface to a player retrieving one of a plurality of different game interfaces that may be presented on the interface, and generating the unique image and operating the lighting element in the pushbutton assembly in accordance with the retrieved one of the plurality of different game interfaces. The method may also include accepting a game selection from a player, and presenting a second a game interface to a player upon an expiration of a predetermined amount of time. The method may likewise include presenting a second a game interface to a player upon an expiration of a predetermined amount of time.

BRIEF DESCRIPTION OF THE DRAWINGS

Features and advantages of the present invention will become apparent from the following description of embodiments thereof, by way of example only, with reference to the accompanying drawings, in which.

Further aspects of the present invention will be apparent from the following description, given by way of example and with reference to the accompanying drawings. Also, various embodiments of the aspects described in the preceding paragraphs will be apparent from the appended claims, the following description and/or the accompanying drawings. It should be understood, however, that the present invention is not limited to the arrangements and instrumentality shown in the attached drawings.

DETAILED DESCRIPTION OF AN EMBODIMENT

Figure 1:
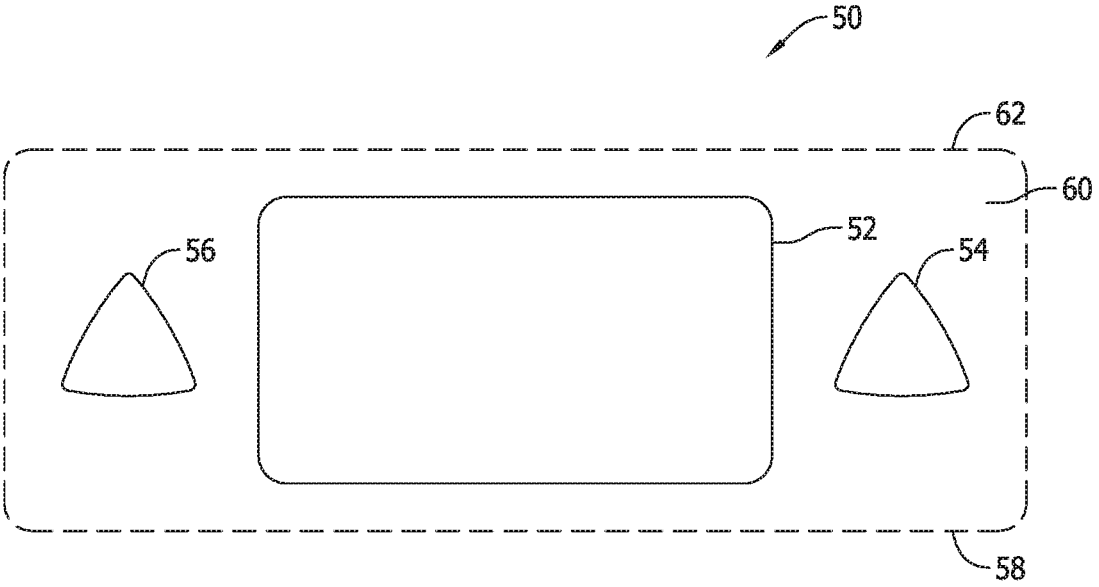
FIG. 1 is a top view of a portion of a player interface for a gaming machine.

FIG. 1 is a top view of a portion of a player interface 50 for a gaming machine. The portion of a player interface 50 includes a video display 52, a first mechanical pushbutton 54 and a second mechanical pushbutton 56 arranged on a cabinet surface 60 having a periphery 62 and defining an area thereupon for the player interface shown. The periphery 62 may in one example be defined by a surface of a gaming machine cabinet that is sometimes referred to as a button deck. The button deck may be located in the gaming machine cabinet below a main game display, for example, and provides for the player to make selections and make inputs to the game being played on the main screen.

While the interface 50 is described in the context of a button deck, it is not necessarily limited to a button deck and may be provided elsewhere on a gaming machine. Further, the interface 50 is not necessarily limited to a gaming machine and may alternative provided in other types of electronic devices for more general gaming purposes (e.g., video game systems or devices that do not relate to games of chance), or for non-game related applications in which a desirable combination of touch screens and mechanical pushbuttons may be beneficial. As such, the interface 50 need not be provided on cabinet surface 60 but on another housing of a different device or otherwise supported in another manner.

The video display 52 is electronically configurable with any graphics desired or required to complete and enjoy, for example, a game of chance. In one example, the touch screen 52 is a capacitive touch screen, and more specifically a liquid crystal display (LCD). The touch screen 52 may be operated by a controller in a known manner to be touch sensitive via activation or inactivation of specific subportions of the touch screen 52 for player interaction with a touch of the finger. When the player touches an activated portion of the screen 52, an electrostatic charge causes a change in capacitance that can be detected, and accordingly a detected change can be input to a controller for response. If the player touches an inactive area on the screen 52, the touch is generally ignored and the controller provides no response. Any number of active and inactive areas can be provided on the touch sensitive video display 52, with the display on the screen changing in response to player touches in the activated areas to provide responsive game feedback to the player. The electronic screen displays including the active and inactive areas are programmed and coordinated with the game being played on the main video display of the machine.

By directly touching different activated areas presented on the touch sensitive video display screen 52, different selection inputs may be provided to the machine by a player, and machine outputs may be provided to the player responsive to the selected inputs. The touch sensitive video display 52 is highly reconfigurable and may provide virtually any graphic scheme desired, within the confines of the size of the touch sensitive video display 52. The touch sensitive video display 52 may interactively display video and animations, provide prompts for player inputs, and enhance game play in a number of aspects.

While the touch sensitive video display 52 can functionally replace a variety of different conventional mechanical pushbuttons or other mechanical input elements (e.g., joysticks, levers, tracker balls, etc.), mechanical pushbuttons 54, 56 are nonetheless desirable as they provide a tactile sensation to a player that the electronic touch sensitive video display 52 cannot provide. The mechanical pushbuttons 54, 56 are therefore distinguished from electronic "button" activated areas that may be provided on the touch sensitive video display 52. Unlike electronic buttons, the mechanical pushbuttons 54, 56 operate via physical movement and displacement of a biased button plunger which generates the tactile feedback, and also may produce an audible sound when the pushbutton 54 or 56 is depressed via the mechanical actuation of the pushbutton. As such, the mechanical pushbuttons 54, 56 are separately provided and independently actuated from the touch sensitive video display 52.

The mechanical pushbuttons 54, 56 may provide a more intuitive gameplay for many players that are accustomed to such pushbuttons, and can be visually prominent in a way that the flat touch sensitive video display 52 does not afford. In the example shown, two pushbuttons 54, 56 are shown on respectively different lateral sides of the touch sensitive video display 52. The player interface 50 in another embodiment may include any number of mechanical pushbuttons, including a single mechanical pushbutton. While the mechanical pushbuttons 54, 56 shown are of the same general size and shape, in another embodiment they may have different sizes and/or different shapes to emphasize or de-emphasize features associated with particular features of the game to assist game play.

In the example shown, the touch sensitive video display 52 is relatively large and occupies a substantial portion of the interface area 62 in the cabinet surface 60. As such, the placement of the mechanical pushbuttons 54, 56 is practically limited to the remainder of the interface area 62. Alternatively, the size of the touch sensitive video display 52 is limited by the number (and size) of mechanical pushbuttons desired and the layout of those mechanical pushbuttons in the interface area 62 on the cabinet surface 60 of the button deck. Accordingly, the player interface 50 is somewhat limited in its ability to be reconfigured for use with a different game than the one for which it was initially designed.

The mechanical pushbuttons 54, 56 in the interface 50 are conventional pushbuttons having a fixed, graphical configuration that is referred to herein as "static" in terms of both appearance and function. The pushbuttons 54, 56 can be provided in desired colors and with desired graphics to complement a specific game associated with the interface. For example, the pushbuttons 54, 56 are opaque and be painted or color-coded, provided with graphic labels, or otherwise stylized to present a graphic theme in combination with the touch screen. In some cases, the pushbuttons may be transparent but fitted with labels or otherwise opaque graphics on the inside of the pushbutton that are visible from the exterior of the pushbutton. Painted indicia, labels and the like may also be provided on the cabinet surface 60 proximate the respective pushbuttons to indicate the function of each pushbutton 54 56.

Once the pushbuttons 54, 56 and the cabinet surface 60 are graphically configured with desired colors, indicia and graphics the pushbuttons 54, 56 and the cabinet surface 60 outside of the touch sensitive video display 52 present a constant (i.e., static) appearance to game players or other observers. While this accomplishes the goals of the game for which the interface 50 was designed, the pushbuttons 54, 56 are not easily adapted in appearance to complement a different game having different a different graphic scheme that may be desirably run on the same machine.

While the pushbuttons 54, 56 may be replaced in the interface 50 with other pushbuttons 54, 56 that have a different graphic configuration, this is not easily accomplished. Either the button deck will need to be replaced entirely with a new deck for the new game, or the pushbuttons and cabinet surface would need to be re-labeled, re-colored, etc., which may entail replacement of the pushbuttons in order to accomplish. If a larger touchscreen area is desired for another game, the entire button deck would need to be replaced and/or a new customized interface 50 would need to be designed, but with limitations as the size of the touch screen imposes practical constraint on the placement of the mechanical pushbuttons, and vice versa, within the available periphery 62 and associated area on the cabinet surface 60.

Figure 2:
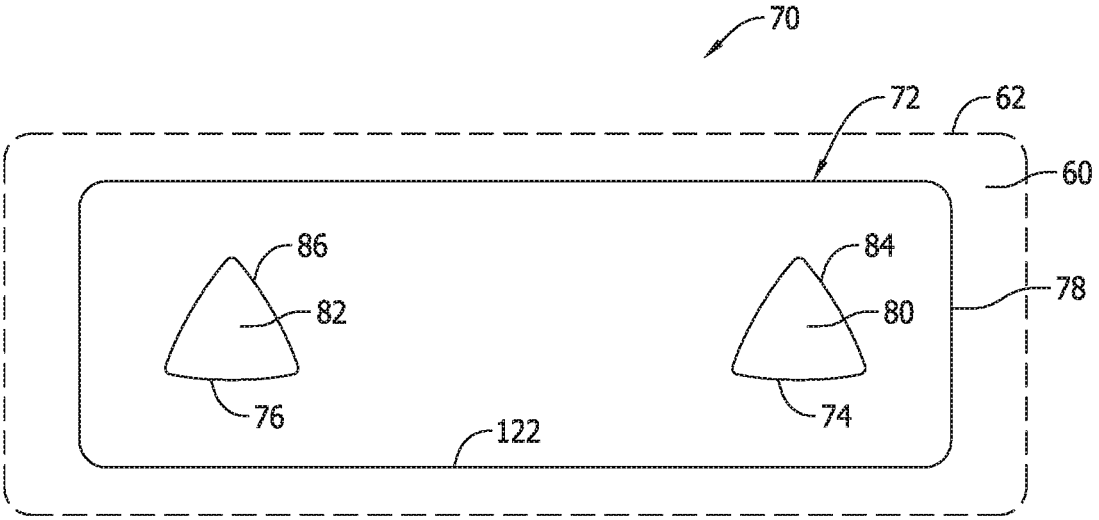
FIG. 2 is a top view of a portion of a player interface for a gaming machine in accordance with an embodiment of the present invention.

FIG. 2 is a top view of a portion of a portion of a player interface 70 for a gaming machine that may be used in lieu of, or in replacement to, the interface 50 described above. The interface 70 includes a video display 72, a first mechanical pushbutton 74 and a second mechanical pushbutton 76 arranged on the cabinet surface 60 having the periphery 62.

Comparing FIG. 1 and FIG. 2, the video display 72 is seen to be substantially larger than the video display 52, while the size of the cabinet surface 60 having the periphery 62 is otherwise unchanged. The larger video display 72 is made possible, at least in part, because the mechanical pushbuttons 74, 76 are now located over and positioned on top of the video display 72 instead of beside the screen 52 as in the example of FIG. 1. Specifically, the video display 72 has an outer periphery 78 that is substantially larger than the outer periphery of the touch screen 52 in FIG. 1, but still comfortably fits in or on the cabinet surface 60.

Like the video display 52, the video display 72 defines a touch sensitive screen area within that is capable of displaying any graphics, videos, animations, or images desired at any desired location, including full screen video/animation/images, partial screen video/animation/images, and any activated or inactivated portions of the touch screen area for player input and game outputs. Unlike the interface 50 wherein the mechanical pushbuttons 54, 56 are located outside the touch sensitive screen area (i.e., outside the outer periphery of the touch screen 52), the mechanical pushbuttons 74, 76 in the interface 70 are located within the touch sensitive screen area (i.e., inside the outer periphery of the touch screen 72). Accordingly, the placement of the mechanical pushbuttons 74, 76 are no longer a limitation on the screen size of the display 72, and the larger touch screen 72 in the interface 70 spans or occupies a much larger portion of the cabinet surface 62 than the touch screen 52 in the interface 50. This combination of a larger touch screen 72 and the mechanical pushbuttons 74, 76 mounted upon the screen 72 opens up a new realm of graphic possibilities on the larger display 72 to change the visual appearance and graphics of the interface 70 to accommodate different games with the same interface 70. As such, a gaming machine including the interface 70 is much more capable to run different games at different times without physical modification of the machine or the interface 70, or otherwise capable of more or less universal use with different games from the perspective of a gaming machine manufacturer.

Furthermore, and unlike the mechanical pushbuttons 54, 56 in the interface 50, the mechanical pushbuttons 74, 76 in the interface 70 are not static but instead are dynamic in terms of appearance and function. Each of the mechanical pushbuttons 74, 76 includes a respective top surface 80, 82 that is transparent such that any graphic or image displayed on the video display 72 is visible to a player through the transparent surfaces of the pushbuttons 74, 76. Specifically, each top surface 80, 82 of the respective pushbuttons 74, 76 has a respective outer periphery 84, 86 that defines a button area within, and a portion of the video display 72 is visible through the button area. This allows the appearance of the pushbuttons 74, 76 to be reconfigurable by changing the image in the button area via the video display 72 that is visible beneath the pushbuttons 74, 76. By generating a distinct or unique image in the button area relative to the rest of the video display 72, the pushbuttons 74, 76 may be made visually prominent on the interface 70 such that the same physical pushbuttons 74, 76 may assume very different visual appearances and make very different visual impressions. In particular, unique images having, different colors, different texts (e.g., game names), different symbols (e.g., game logos), and different graphic schemes are possible to display in the button area to realize pushbuttons 74, 76 having substantially different appearances to accommodate different games without making any physical change to the pushbuttons 74, 76 themselves.

As such, and in contrast with the static pushbuttons 54, 56 described above, the pushbuttons 74, 76 are dynamic pushbuttons having practically any appearance desired. The appearance of the pushbuttons 74, 76 may be electronically changed via the video display 72 to accommodate different games, may be electronically changed via the video display 72 to have a different appearance at different times in the same game, and may also serve different functions in the same games or different games via electronic reconfiguration of the touchscreens in and around the pushbuttons 74, 76.

In the example shown, two pushbuttons 74, 76 are shown on each respective lateral side of the display screen 72 in particular locations. The player interface 70 in another embodiment, however, may include any number of pushbuttons, including a single pushbutton, at any desired location on the touch screen 72. Also, while the pushbuttons 74, 76 shown are of the same general size and shape, in another embodiment they may have different sizes and/or different shapes.

Figure 3:
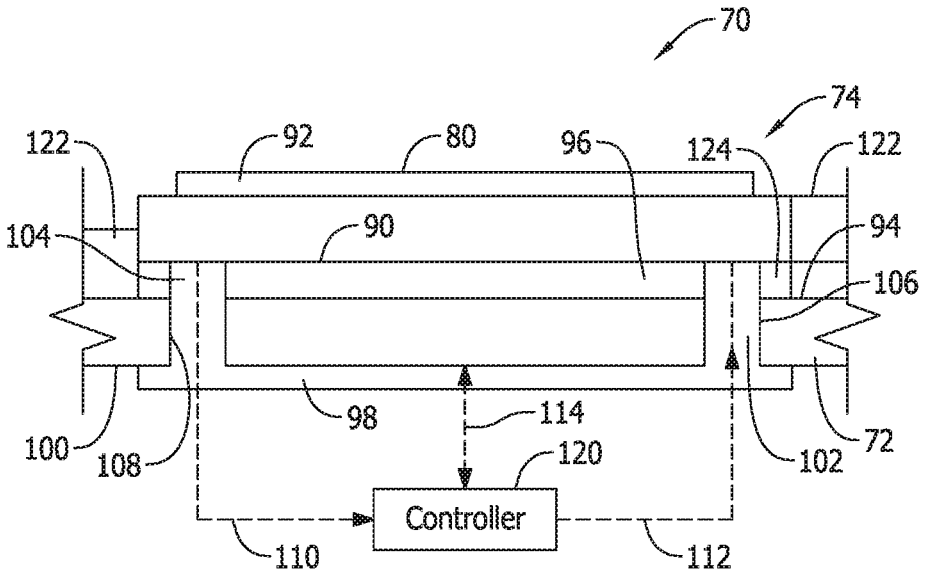
FIG. 3 is a partial cross-sectional view of the player interface shown in FIG. 2.
Figure 16:
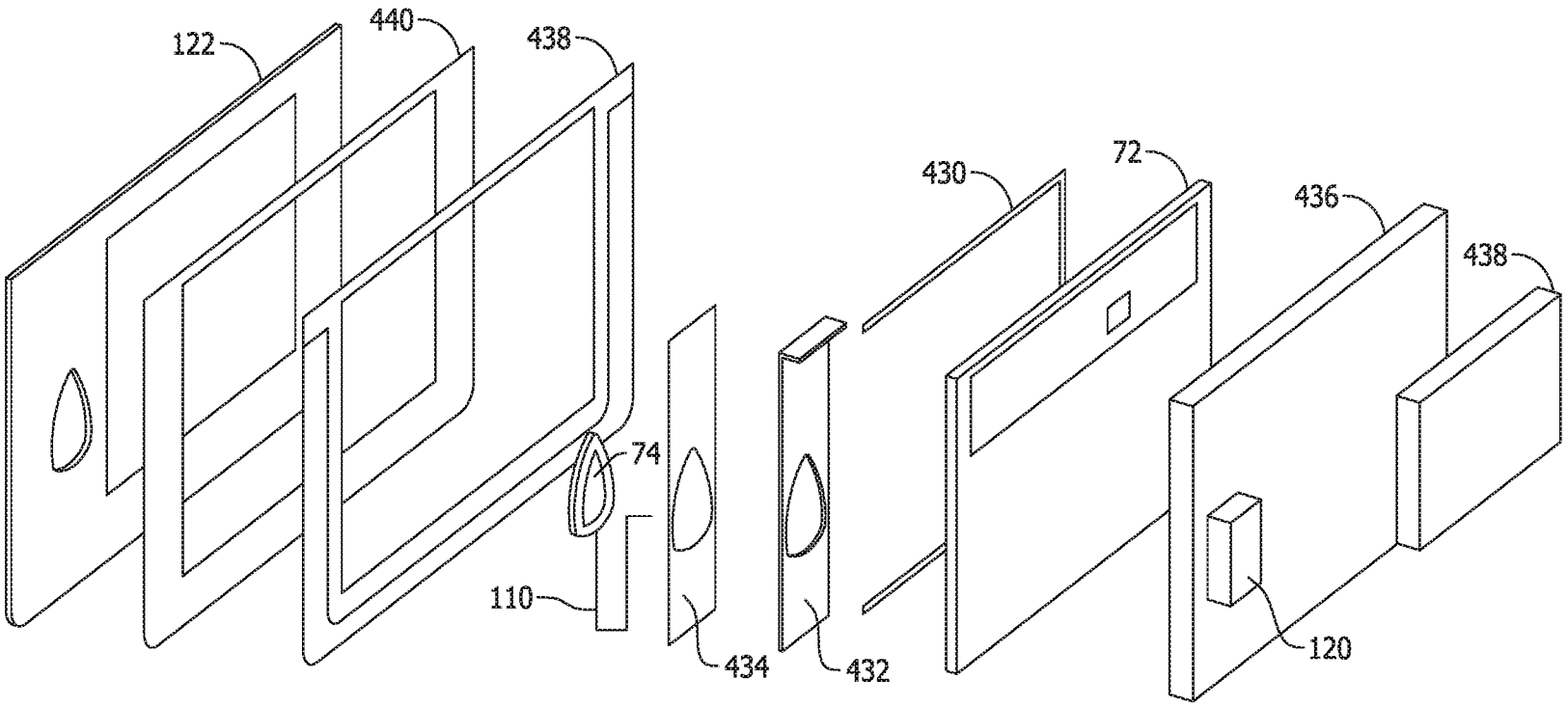
FIG. 16 is an exploded view of an embodiment of a player interface for a gaming machine.

FIG. 3 is a partial cross-sectional view of the player interface 70 in the area of the pushbutton 74 to illustrate the button assembly in a first embodiment. The pushbutton 76 may be mounted in a similar manner to the pushbutton 74. FIG. 16 shows an exploded view of display assembly including the pushbutton 74 in a second embodiment.

The pushbutton 74 is shown to include a base 90 and plunger 92 that operate in a conventional manner to close a circuit and output a signal to a gaming controller 120. The plunger 92 is biased upwardly to an opened position and is depressed by a user to close a switch and provide the signal output. When the player releases the plunger 92, the plunger 92 returns to its original position and is ready to be pressed again. The plunger 92 in this example includes the transparent top surface 80 allowing any graphic displayed on the video display 72 to be visible therethrough.

The base 90 of the pushbutton 74 is located in a spaced relation from a front or top surface 94 of the video display 72 in the example embodiment shown. For the purposes of discussion here, the top surface or the front surface 94 refers to the side of the display screen that is intended for viewing the graphics, images, colors, or video generated on the screen. The spaced relation creates a small gap 96 between the pushbutton base 90 and the touch screen top surface 994. The gap 96 in contemplated embodiments is very small and is practically unnoticeable to the human eye such that the pushbutton 74 appears to be flush mounted on the video display 72.

Further, the pushbutton 74 is low profile in a dimension extending perpendicular to the video display surface, and avoids any "tunnel effect" in viewing the touch screen through the pushbutton 74. That is, the pushbutton 74 has a relatively small height dimension (extending vertically in the plane of FIG. 3) that projects from the surface of the video display 72. The small gap and low profile of the pushbutton 74 in combination provide a clear view of the video display 72 through the button, while still providing a three-dimensional prominence to the pushbutton 74 in the interface 72. In another embodiment, a larger gap and/or higher profile button could instead be used, and if necessary or desired an optic element could be provided to bring the touch screen image to the top surface of the pushbutton and avoid an undesirable tunnel effect.

The gap 96 also ensures that the touch screen 72 cannot be activated by, or possibly even damaged by, a player depressing the pushbutton plunger 74 with an undue amount of force, as an excited player may sometimes do. As further reinforcement in this regard, a support plate 98 located on a bottom side 100 of the video display 72 opposite the pushbutton 74 that extends over the top surface 94. The support plate 98 may be fabricated from metal and may include mounting feet 102, 104 that respectively extend through openings 106, 108 in the video display 72 between the opposing top and bottom sides 94, 100. Alternatively, the pushbutton 74 may include support features that extend through the openings 106, 108 and connect to the support plate 98, or fasteners could be extended through the openings 106, 108 to connect the support plate 98 and the pushbutton 74 to effect the desired gap 96. Either way, once the support plate 98 and the pushbutton 74 are connected, joined or fastened to one another the pushbutton 74 is mechanically isolated from the touch screen 72 and may withstand applied forces that could otherwise damage the touch screen 72. This type of mechanical isolation is sometimes referred to as a "floating" pushbutton. In contemplated embodiments, the pushbutton 74 is fabricated from plastic, while the support plate 98 is fabricated from metal. Other suitable materials are possible for the pushbutton 74 and the support plate 98, however, and may be utilized.

While mechanical isolation of the pushbutton 74 and the video display 72 is beneficial for the reasons stated, depending on the configuration of the pushbutton 74 and the specifics of the video display utilized, damage to the video display may not be of practical concern and the pushbutton 74 could instead be seated upon the top surface 72 of the touch screen without a gap. As such, the support plate 98 and/or the gap 96 described above may be considered optional in some embodiments and need not be employed.

In a contemplated embodiment, the video display 72 is a liquid crystal display (LCD) including a capacitive touch screen layer 122 such as an insulator such as glass, coated with a transparent conductor such as indium tin oxide (ITO). Alternatively, another type of capacitive touch screen layer may be utilized, including but not necessarily limited to an active-matrix organic light-emitting diode (AMOLED) display. as further examples, a touch screen layer 122 or other touch sensitive element may be provided to realize a surface capacitive display or a projective capacitor display. Briefly, a surface capacitive display includes sensors at the corners of the screen and a thin evenly distributed film across the surface of the layer 122, whereas a projective capacitive display uses a grid of rows and columns on the layer 122 with a separate chip for sensing. Capacitive screen technology is otherwise known and not described further herein.

As shown in FIG. 3 (and also FIG. 16), the capacitive touch screen layer 122 includes an opening or recess 124 that is complementary in shape to the pushbutton 74, and the pushbutton 74 is mounted within the opening or recess 124. The touch sensitive screen area is defined on the outer surface of the layer 122, and since the layer 122 surrounds the outer periphery of the pushbutton 74 in this example, the entire area of the video display 72 surrounding the pushbutton 74 may be touch sensitive. As such, the pushbutton 74 is sometimes referred to as floating within a touch sensitive interface implemented with the capacitive touch screen layer 122, which extends around, but not beneath, the pushbutton 74. This is expressly contrasted with the pushbuttons 54, 56 in the interface 50 shown in FIG. 1, which are entirely outside the video display 52 and therefore spaced from its corresponding capacitive touch screen layer 122.

The opening 124 in the capacitive touch screen layer 122 beneficially allows the video display 72 to dynamically alter the appearance of the pushbutton 74 in a cost effective manner by using a relatively small portion of the video display 72 (as opposed to a separately provided video display in the pushbutton 74 that would be less cost effective). The opening 124 in the capacitive touch screen layer 122 also realizes a lower profile assembly (i.e., a smaller thickness dimension in the plane of FIG. 3), and also realizes a lighter assembly. From a manufacturer's perspective, the assembly provides advantages of reducing parts count, reducing certain material costs, and providing ease of assembly while still realizing a highly desirable, dynamically reconfigurable interface.

In alternative embodiments, alternative touchscreen technologies may likewise be incorporated. For example, Resistive Touch screen technology, Surface Acoustic Wave (SAW), and Infrared (IR) Touch screen technology may likewise be incorporated to realize otherwise similar effect, namely touch screen capability with a dynamic pushbutton rendering a portion of the video display through the pushbutton 74. Further, the dynamic features of the pushbutton 74 do not require a touch screen in all instances, and a simpler video screen or monitor may be used instead. That is, the capacitive touch screen layer 122 need not be utilized in all embodiments where simpler interfaces are desired with a reduced number of inputs from a player. Insulators such as glass may be used without capacitive touch screen elements thereon, and openings may be provided in the glass for mounting of the pushbutton 74 as described above with similar advantages to those described above.

Finally, as shown in FIG. 3, the pushbutton assembly includes a first wire 110 connecting the pushbutton 74 and the controller 120 such that the controller 120 receives a signal input when the pushbutton 74 is depressed. A second wire 112 is shown such that a controller 120 can output a signal to the pushbutton 74, such as to control the lighting element described below. A third wire 114 is shown to establish and input/output connection with the controller 120 to operate the video display 72. The wires 110, 112 are shown extending through openings 106, 108 in the video display 72 for a neat and clean appearance from the top side 94. Exemplary controllers are described more specifically below, and while one controller 120 is shown in FIG. 3 separate controllers may be provided to effect certain functionality in a distributed control scheme.

While wires 110, 112 extending through the touch screen 72 is desirable for its clean look and also as providing some protection to the wires from possible damage, it is not in all instances required. FIG. 16 shows another example wherein openings 106, 108 are not provided in the video display 72 and the necessary wires are run of the front and rear surfaces of the display beneath the capacitive touch screen layer 122. Regardless, the wires 110, 112 can be bundled to facilitate the desired connections.

Referring now to FIG. 16 in exploded view, another assembly is shown providing similar advantages with different structure. As seen in FIG. 16, the video display 72 is provided with a spacer element 430 provided on its front side and a support plate or bracket 432 that clips to the housing of the video display 72. The support plate or bracket 432 includes an opening as shown that receives the mechanical pushbutton 74, which may be mounted thereto with fasteners in a spaced or gapped relation to the front surface 94 of the video display 72 on the front side. As such, the pushbutton 74 that is mounted to the bracket 432 floats over the top surface or front surface of the display 72 while being mechanically isolated from the screen via the support plate 432. An optional gasket 434 may be provided to waterproof the assembly, and the wire 110 (and also the wires 112 or 114) extend on the surface of the gasket 434, around the lower edge of the bracket and the display 74 and extend to the controller 120 provided on the rear side of the display screen 72 with the control circuitry 436 of the video display 72 that is implemented in various circuit boards. The wire may be a flexible transparent wire that is not easily seen, if at all, under the glass that is provided over the top of the gasket 434 and the button bracket 432.

Figure 15:
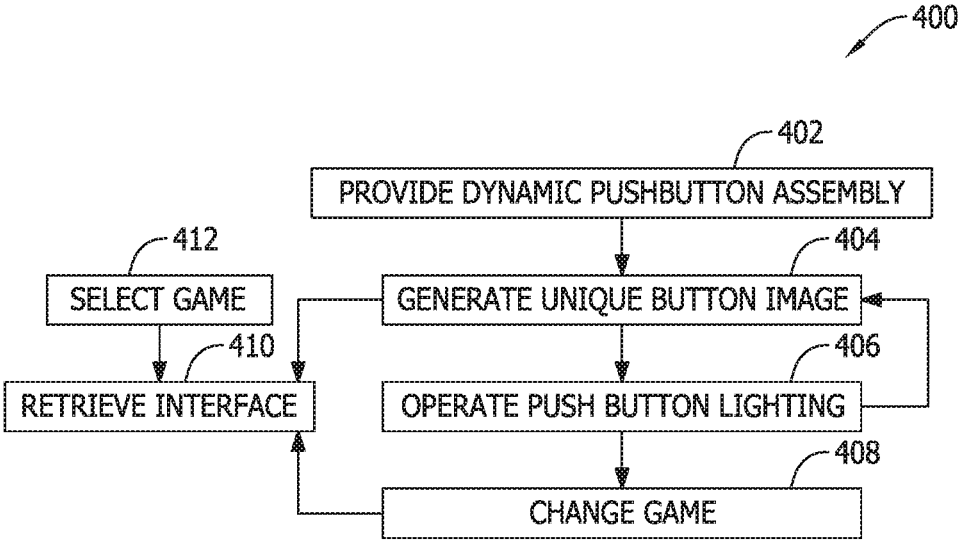
FIG. 15 is flowchart of processes executable by a gaming machine including a player interface according to an embodiment of the present invention.

A glass bracket 438 is also provided on the front side of the video display 72 that may attached to a housing or frame of the display 72, double sided tape 440 is applied to the front side of the glass bracket 438, and the glass insulator 122 including the capacitive touch screen layer 122 is adhered to the double sided tap 440 as shown in FIG. 15. The opening 124 is shown in the glass insulator and is fitted over the pushbutton 74 to provide the low profile interface including the pushbutton 74. An additional bracket 120 may be provided on the rear side of the assembly to mount the interface to the gaming machine.

While one pushbutton 74 is shown in FIG. 16, a second pushbutton 76 may be included by providing additional bracket 432 and additional openings in the capacitive touch screen layer 122 to provide the interface shown in FIG. 2. Numerous variations are possible including different numbers of buttons located in different relative positions in the interface. More than one pushbutton could be mounted to the same bracket, and pushbuttons of different sizes and shapes may be incorporated as desired.

Figure 4:
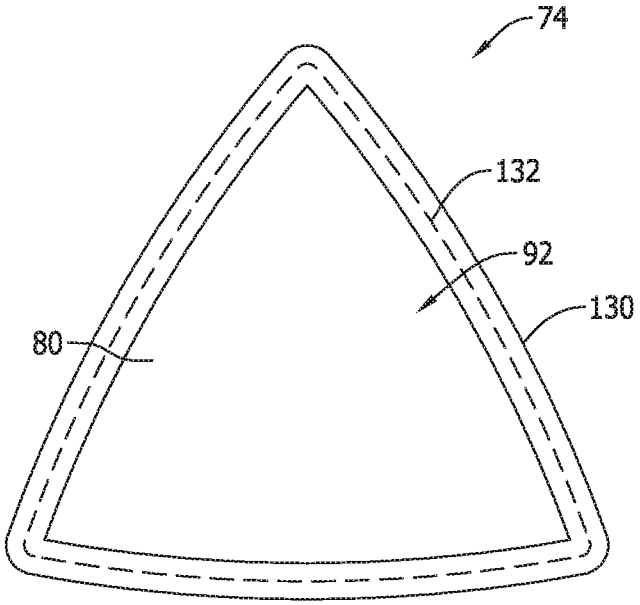
FIG. 4 is a top view of a dynamic pushbutton in accordance with an embodiment of the present invention.

FIG. 4 is a top view of the pushbutton 74 in accordance with a further embodiment of the present invention. The pushbutton 76 may constructed similarly to the pushbutton 74.

The pushbutton 74 includes a bezel 130 surrounding the plunger 92, and the bezel is equipped with a lighting element 132 (shown in phantom in FIG. 4) for illumination of the pushbutton 74. The bezel 130 has a low profile in its height dimension (i.e., along an axis extending perpendicular to the plane of the page in FIG. 4), but is relatively large in profile in the length and width dimension (i.e., in the plane of the page of FIG. 4) in the illustrated example. This provides a relatively large viewing area through the transparent pushbutton in the button area to produce the desired appearance of the dynamic pushbutton 74. The low profile height of the bezel 130 but may be of the same or different height as the plunger 92 to provide different visual effects and to accommodate different types of lighting elements and produce different lighting effects.

In a contemplated embodiment, the lighting element 132 is a light emitting diode (LED) element. Specifically, the LED lighting element may be a multicolor red, green blue (RGB) Halo lighting element extending around the entire perimeter of the transparent surface 80 of the plunger 92 within the bezel 130. As such, the lighting element may provide accent lighting to the pushbutton 74 in one of a plurality of different colors, providing for even further variability in the appearance of the pushbutton 74. In another embodiment, the lighting element may be a type other than an LED element, and may extend only at a certain selected location (or locations) in the bezel 130 rather than around the entire perimeter.

Aside from illumination in different colors and intensities, the bezel 130 may be transparent or partly transparent to provide different lighting effects and create different visual impressions. For example, the top surface of the bezel 130 may be opaque while the inner sidewall is transparent, providing a glow around the inside of the pushbutton 74 surrounding the plunger 92. As another example, the top surface of the bezel 130 may be opaque while the outer sidewall is transparent, providing a glow around the outside of the bezel 130 opposite the plunger 92. Likewise, the top surface of the bezel 130 may be transparent while the sidewalls are opaque, providing a glow around the inside of the pushbutton 74 surrounding the plunger 92 that can be seen from the top, but not the sides. Various different direct and indirect lighting options are possible, and sophisticated lighting effects are possible that are also dynamic, as opposed to static, as the game is played or to attract another player. For example, the lighting element 130 may be brightened or dimmed, turned on and off, or change colors to signify different features or accentuate different aspects of a game in progress. Blinking and chasing light effects may also be implemented. Unique visual impressions to observers and potential players may draw interest to the gaming machine, apart from any visual impression of the touch screen 72 being visible through the pushbutton 74. While the lighting element 130 may enhance the dynamic appearance of the button, it may in some instances be considered optional and need not be provided when the display 72 provides sufficient brightness to meet the needs of a particular game application.

Unlike the static pushbuttons described above where each pushbutton is labeled for a particular purpose, the dynamic features of the pushbutton 74 allow it to be easily reconfigured to serve different functions in the same game (or different functions in different games) in a manner that is intuitive to a player. For example, the touch screen 72 can display a viewing window just above the pushbutton 74 reading (Press to Start) and serve to commence a game. After the game commences, the touch screen 72 can display another viewing window just above the pushbutton 74 directing the user to press the pushbutton for a completely different, and unrelated purpose to the start function, such as "Double Up" in the course of a game. The pushbutton 74 can clearly be designated or re-designated (i.e., configured and re-configured) with clear prompts to the player to use the pushbutton 74 for different purposes as desired. The lighting on the pushbutton 74 may also be changed with the different possible functions of the pushbutton 74.

In a similar manner, and still considering the interface 70 the pushbutton 74 can be a "Start" pushbutton for a first game while the pushbutton 76 can be a "Start" pushbutton for a second game. The pushbuttons 74, 76 and the touch screen 72 can also easily be dynamically configured and re-configured to facilitate single-player and multi-player games with different interface displays, either within the same game or in different games.

Figure 5:
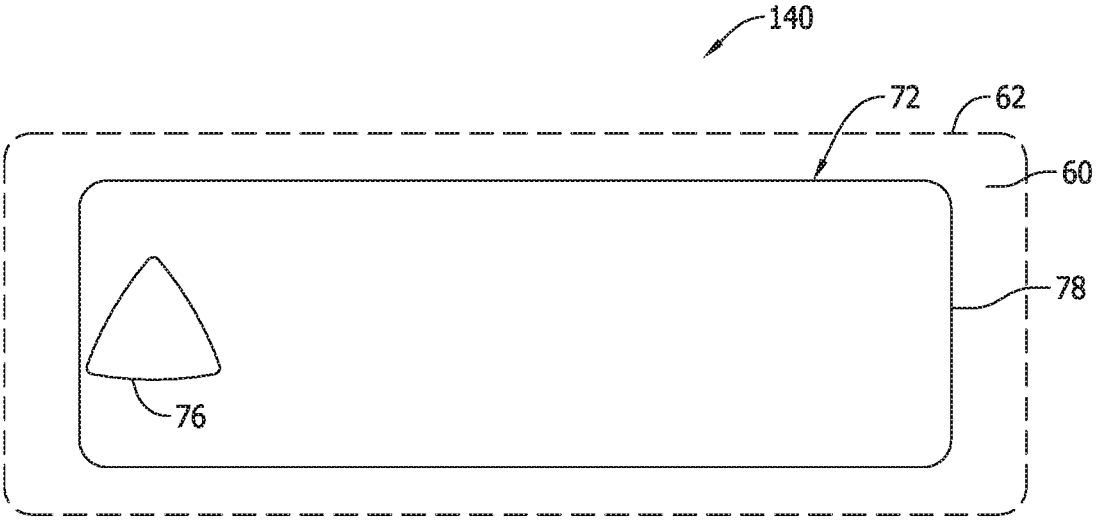
FIG. 5 is a top view of a portion of a player interface for a gaming machine in accordance with another embodiment of the present invention.

FIG. 5 is a top view of a portion of a player interface 140 for a gaming machine in accordance with another embodiment of the present invention. In the player interface 140, only the pushbutton 76 is included, and the pushbutton 76 is located immediately adjacent an end of the outer periphery 78 of video display screen instead of spaced from the outer periphery 78 as in the interface 70 (FIG. 2). A different visual effect is therefore realized, but the pushbutton 76 is still dynamic to render the corresponding area of the touch screen 72 visible through the top surface of the pushbutton 76. In general, the pushbutton 76 (and the pushbutton 74 or any other pushbutton desired) may be located anywhere in the confines of the outer periphery 78 of the video display with similar benefits, but providing different visual impressions.

Figure 6:
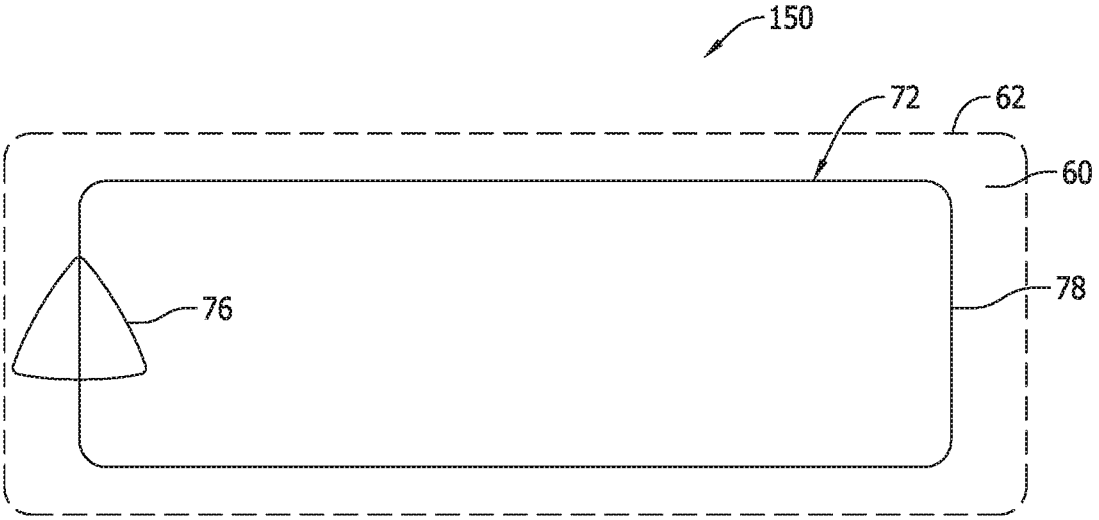
FIG. 6 is a top view of a portion of a player interface for a gaming machine in accordance with another embodiment of the present invention.

FIG. 6 is a top view of a portion of a player interface 150 for a gaming machine in accordance with another embodiment of the present invention. In the player interface 150, only the pushbutton 76 is included, and the pushbutton 76 is located partly over the outer periphery 78 of the video display 72 instead of entirely within the outer periphery as in the interfaces 140 and 70. In the example shown, instead of being spaced from the outer periphery 78 as in the interface 70 (FIG. 2), the pushbutton 76 straddles the outer periphery 78 of the video display 72. As a result, part of the pushbutton 76 extends over the touch screen and part of it does not. A different visual effect is therefore realized, but the pushbutton 76 is still dynamic to render the corresponding area of the touch screen 72 visible through the top surface of the pushbutton 76. In general, the pushbutton 76 (and the pushbutton 74) may be located anywhere on the cabinet surface 60 as long as at least part of the pushbutton 76 extends within (i.e., inside of)) the outer the outer periphery 78 of the video display 72. In an embodiment of this type, a portion of the top surface of the pushbutton 76 may be transparent and a portion of the top surface of the pushbutton may be opaque providing still further visual effects.

It should be realized that combinations of the interfaces 70, 140 and 150 are possible. That is, in the same interface, at least one pushbutton may be spaced from the outer periphery 78 of the touch screen 72, at least one pushbutton may be located adjacent the outer periphery 78 of the touch screen 72, and/or at least one pushbutton may extend over the outer periphery 78 of the touch screen 72.

An embodiment is also contemplated wherein dynamic pushbuttons 74, 76 can be provided in combination with one or more static pushbuttons 54, 56 as in the interface 50 (FIG. 1). Still further visual effects and game functionality can be realized with combinations of dynamic and static pushbuttons.

While each of the interfaces 70, 140, 150 include a single video display 72, more than one video display may be provided in another embodiment, and different dynamic pushbuttons may be associated with different video displays. For example, by providing a touch screen in the area of the pushbuttons 54, 56 in the interface 50 of FIG. 1, the pushbuttons 54, 56 could be replaced with dynamic pushbuttons as described in relation to FIGS. 2 through 4. The result would be three touch screens, two of which include the dynamic pushbutton assemblies, with the third touch screen located between the dynamic pushbutton assemblies. As noted above, however, the dynamic pushbutton assemblies do not necessarily require touch sensitive screens, and as such an arrangement similar to the layout of FIG. 1 could be realized using a larger center touch screen and two smaller non-touch screens on each side of the center screen to realize dynamic pushbuttons and functionality described above.

By varying the numbers and sizes of display screens in the interface, and the numbers of sizes of static or dynamic pushbuttons in the interface, the number of different variations of interface layouts is practically unconstrained. For any given layout, the dynamic pushbuttons allow enormous variation in the visual impression of the layout for use with multiple games employing different graphic themes.

Figure 7:
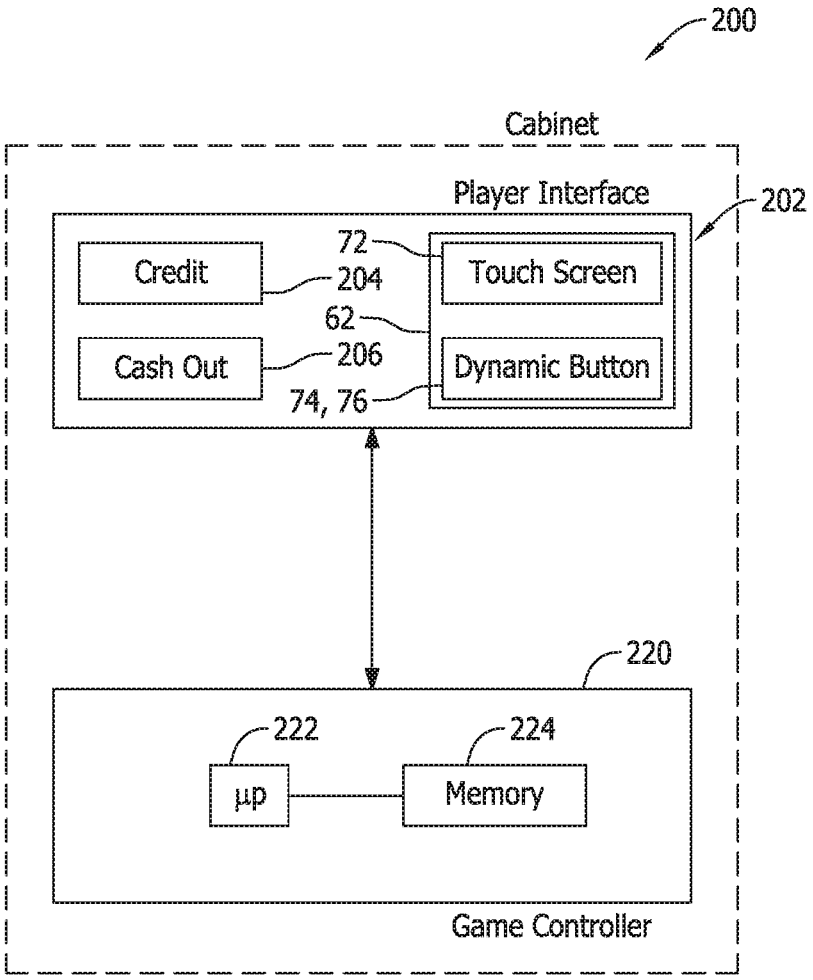
FIG. 7 is a schematic block diagram of core components of a gaming system in accordance with an embodiment of the present invention.

FIG. 7 is a schematic block diagram of core components of a gaming system 200 in accordance with an embodiment of the present invention. The gaming system 200 may be implemented in various forms.

In a first form, a standalone gaming machine is provided wherein all or most components implementing the game are present in a player operable gaming machine.

In a second form, a distributed architecture is provided wherein some of the components implementing the game are present in a player operable gaming machine and some of the components implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, a system architecture may be provided wherein a gaming machine is networked to a gaming server and the respective functions of the gaming machine and the gaming server are selectively modifiable. For example, the gaming system may operate in standalone gaming machine mode, "thick client" mode or "thin client" mode depending on the game being played, operating conditions, and so on. Other variations will be apparent to persons skilled in the art.

Irrespective of the form, the gaming system 200 includes several core components. At the broadest level, the core components are a player interface 202 and a game controller 220 as illustrated in FIG. 7. The player interface 202 is arranged to enable manual interaction between a player and the gaming system 200 and for this purpose includes various input/output components for the player to enter instructions and play the game.

Components of the player interface 202 may vary from embodiment to embodiment but will typically include a credit mechanism 204 to enable a player to input credits, a cash out element 206 allowing a player to receive payouts, one or more touch screens 72 and dynamic pushbuttons 72, 74 enabling a player to input game play instructions and receive outputs and feedback from the system 200.

The game controller 220 is in data communication with the player interface 202 and typically includes a processor 222 that processes the game play instructions in accordance with game play rules and outputs game play outcomes to the display. Typically, the game play instructions are stored as program code in a memory 204 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server. While one controller 220 is shown, it is understood that multiple controllers may be provided in concert with one another to coordinate the functions of the various touch screens and dynamic pushbuttons and lighting options provided.

Figure 8:
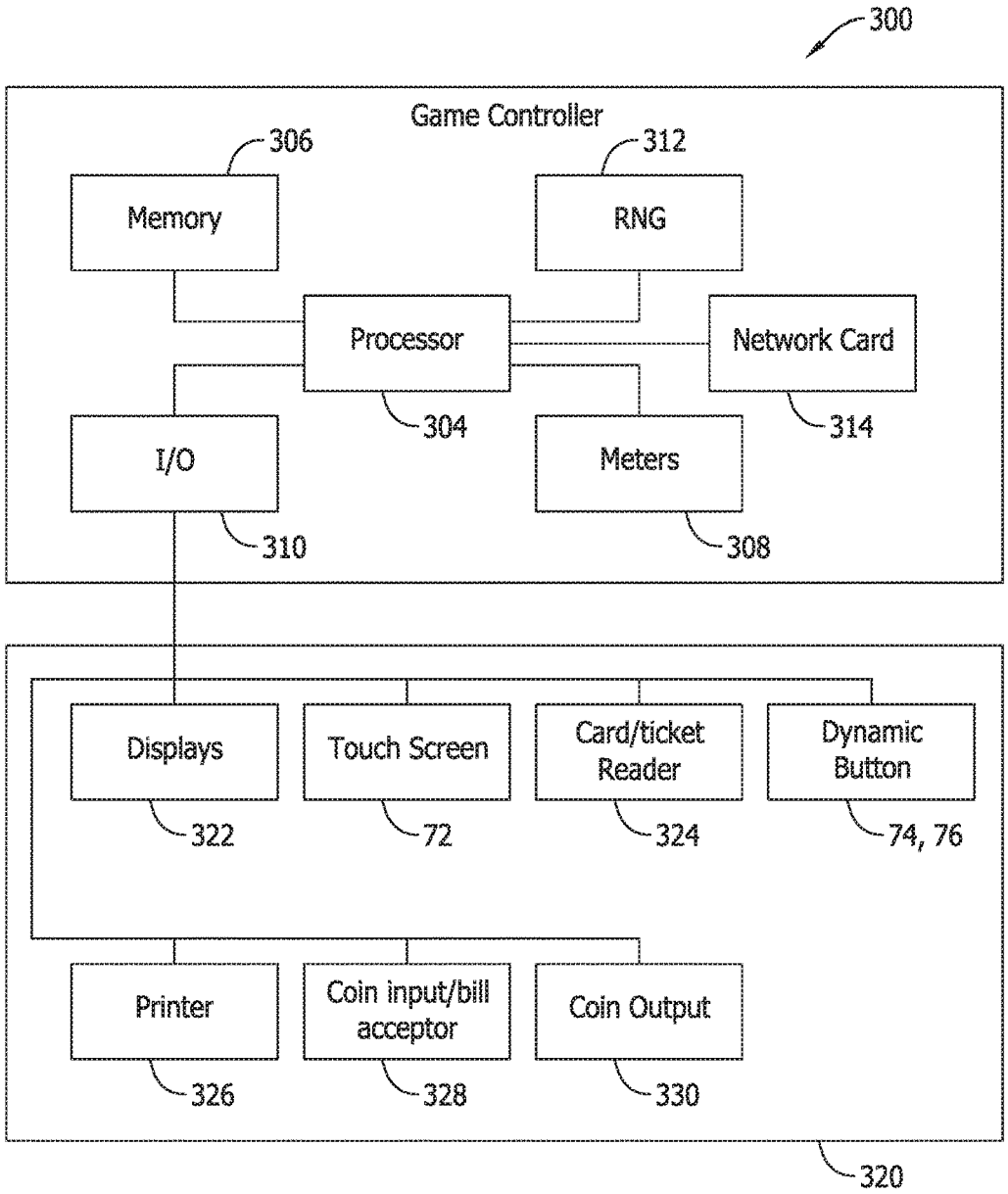
FIG. 8 is a schematic block diagram of operative components of the gaming machine shown in FIG. 7.

FIG. 8 is a schematic block diagram of operative components of a gaming machine 300 including operative components of a typical gaming machine which may be the same as or different to the gaming system 200 of FIG. 7.

The gaming machine 300 includes a game controller 302 having a processor 304. Instructions and data to control operation of the processor 304 are stored in a memory 306, which is in data communication with the processor 304. Typically, the gaming machine 300 will include both volatile and non-volatile memory and more than one of each type of memory, with such memories being collectively represented by the memory 306.

The gaming machine 300 has hardware meters 308 for purposes including ensuring regulatory compliance and monitoring player credit, an input/output (I/O) interface 310 for communicating with peripheral devices of the gaming machine 300. The input/output interface 310 and/or the peripheral devices may be intelligent devices with their own memory for storing associated instructions and data for use with the input/output interface or the peripheral devices. A random number generator module 312 generates random numbers for use by the processor 304. Persons skilled in the art will appreciate that the reference to random numbers includes pseudo-random numbers.

In addition, the gaming machine 300 may include a communications interface, for example a network card 314. The network card may, for example, send status information, accounting information or other information to a central controller, server or database and receive data or commands from a central controller, server or database.

In the example shown in FIG. 8, a player interface 320 includes peripheral devices that communicate with the game controller 302. Such devices include one or more main game displays 322, an interface display 72 and/or dynamic pushbuttons 74, 76, a card and/or ticket reader 324, a printer 326, a bill acceptor and/or coin input mechanism 326 and a coin output mechanism 330. Additional hardware may be included as part of the gaming machine 300, or hardware may be omitted based on the specific implementation.

Figure 9:
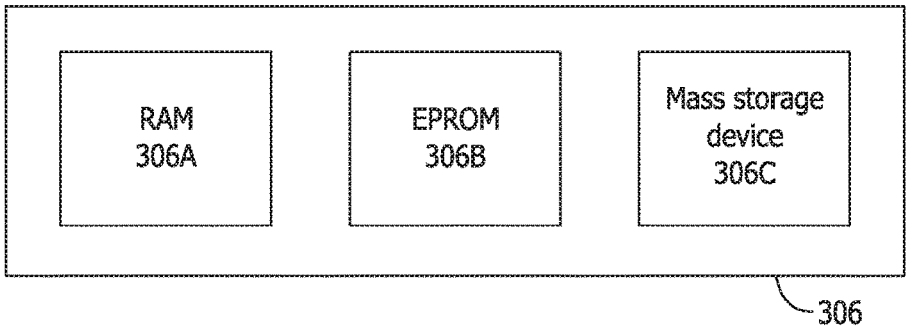
FIG. 9 is a schematic block diagram of components of a memory of the gaming machine shown in FIG. 2.

FIG. 9 shows a block diagram of the main components of an exemplary memory 306. The memory 306 includes RAM 306A, EPROM 306B and a mass storage device 306C. The RAM 306A typically temporarily holds program files for execution by the processor 304 and related data. The EPROM 306B may be a boot ROM device and/or may contain some system or game related code. The mass storage device 306C is typically used to store game programs, the integrity of which may be verified and/or authenticated by the processor 304 using protected code from the EPROM 306B or elsewhere.

It is also possible for the operative components of the gaming machine 300 to be distributed, with the example input/output devices in the player interface 320 to be provided remotely from the game controller 302. It is also possible for the controller 302 to communicate with player interfaces 302 of multiple and different gaming machines.

Figure 10:
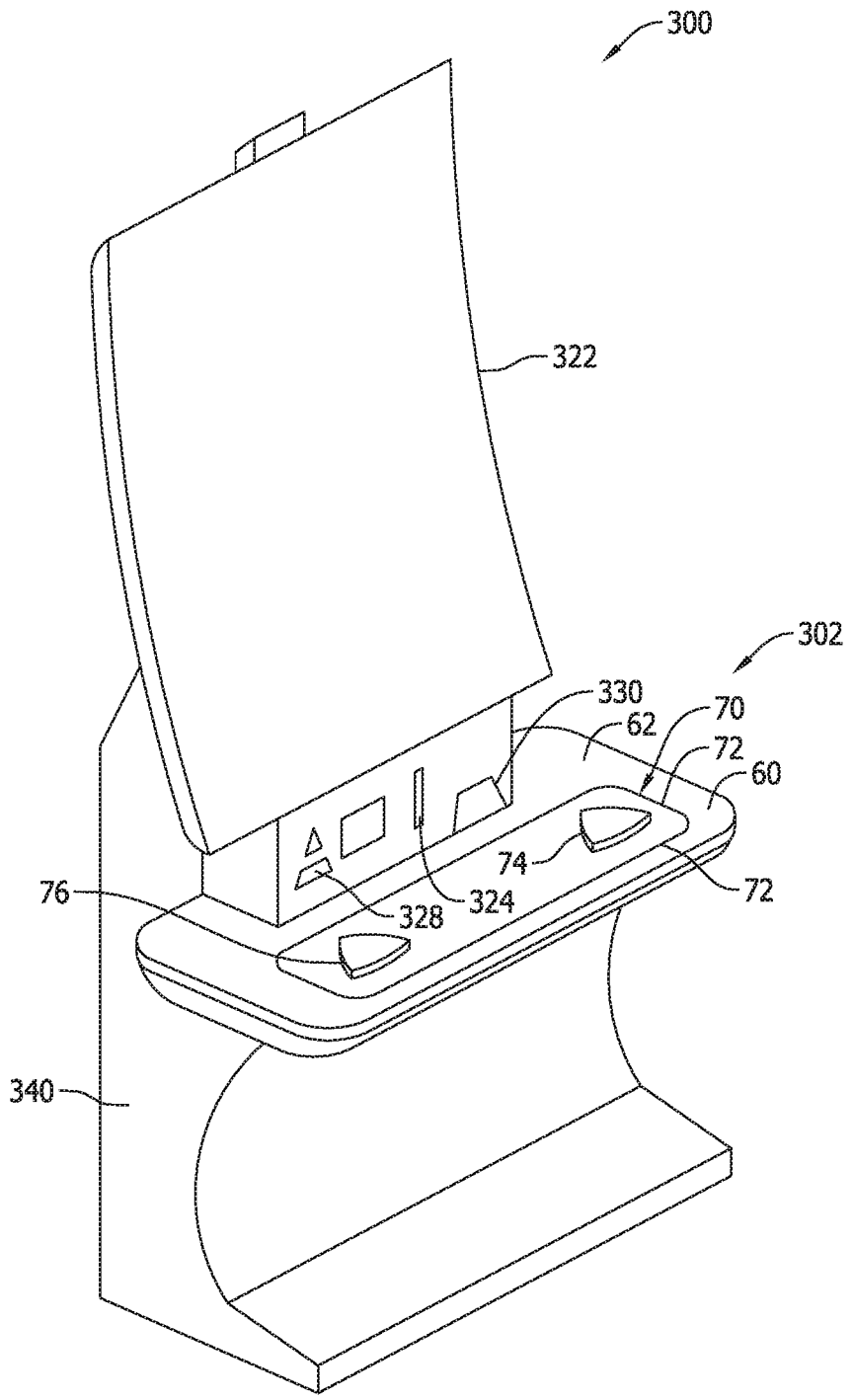
FIG. 10 is a perspective view of the gaming machine shown in FIG. 7 in accordance with an embodiment of the present invention.

FIG. 10 is a perspective view of the gaming machine 300 shown in FIG. 8 in accordance with an embodiment of the present invention. In the illustrated example, the machine 300 is a stand-alone system.

The gaming machine 300 includes a console or cabinet 304 that supports the main game display 322 on which is displayed representations of a game that can be played by a player. The button deck 62 is supported by the cabinet 304 below the main game display 322. The player interface 302 includes the play interface portion 70 (including the video display 72 and dynamic pushbuttons 74, 76) on the button deck 62, and the input/output element 324, 338, 330 adjacent the button deck 362 and being built-in to the cabinet 340. Various different credit input mechanisms may also be employed, for example, a card reader for reading a smart card, debit card or credit card. A player marketing module may be provided having a reading device may also be provided for the purpose of reading a player tracking device, for example as part of a loyalty program. The player tracking device may be in the form of a card, flash drive or any other portable storage medium capable of being read by the reading device.

Figure 11:
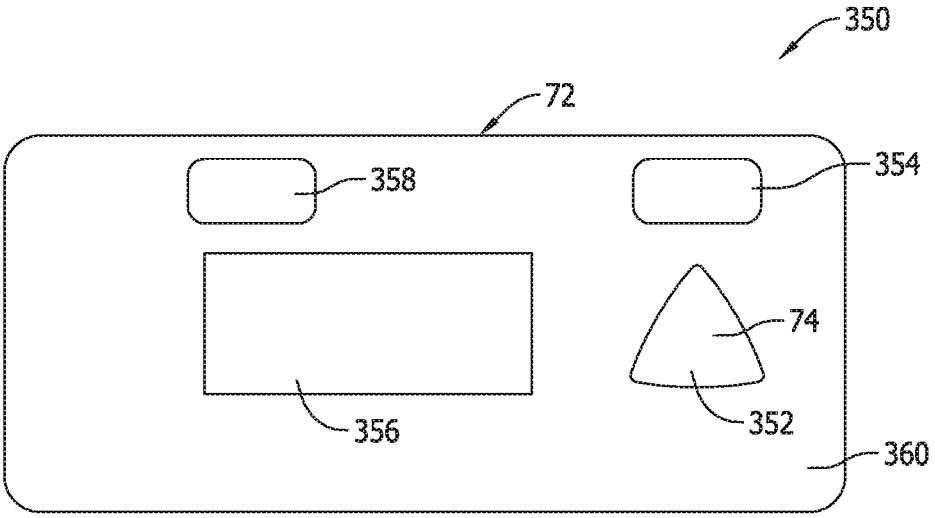
FIG. 11 is a top view of a first graphical configuration of a player interface in accordance with an embodiment of the present invention.

The main display 322 in the example shown is a curved screen display, although it may alternatively be a flat screen. While a single main display 322 is shown, multiple displays may in combination be presented to a player. In various different embodiments, the main display 322 may be a cathode ray tube screen device, a liquid crystal display, a light emitting diode (LED) display, a plasma screen display, or any other suitable video display unit providing an appropriate picture and resolution for the game being played. Combinations of different displays of different types and or different sizes and configuration (e.g., flat or curved) may also be provided FIG. 11 is a top view of a first graphical configuration of a player interface 350 in accordance with an embodiment of the present invention. The interface 350 may be implemented in the machine 300. In the example shown, the video display 72 generates a first image 352 in the button area wherein the pushbutton 74 resides. The first image may include a colorful representation of a first game, including a name or logo of the game. The lighting in the pushbutton 74 may be set to complement the color of the first image 352.

A first viewing window 354 is generated above the button area which may include a first graphic or instruction calling attention to the pushbutton 74.

A second and much larger window 356 is generated in a center portion of the video display 72, and such window 356 may include activated touch screen areas, a video presentation or animation either promoting the game, allowing a user to learn about the game, or facilitating game play.

A third window 358 is generated and is smaller than the other two windows 354, 356. The third window 358 may indicate the card or ticket reader or the acceptor element located on the cabinet adjacent the window as shown in FIG. 10.

The reminder of the video display 72, not occupied by the pushbutton 74 or the windows 364, 356 and 358 is a background area 360 that may display a corresponding non-active background image (and possibly no image) to effect a desired color scheme or game theme. In one example, the background 360 can be set to a color that matches the cabinet (e.g., black) while the button area may glow a bright color (e.g., yellow) with softer colors in the windows 354, 356, 358 and make much of the touch screen 72 to effectively disappear, while the button area is an effective focal point for a player. At any time desired, however, the background 362 can be changed to a player's surprise or to attract attention of a possible player. Likewise, during game play, the touch screen may maintain the button area 352 and the windows 364, 356 and 358 and dark background 360 to provide a relatively simple interface, or may expand the interface during game play (or at specific times of the game) as desired by enlarging the windows 356, 358, adding additional windows or otherwise using more of the available background space for game play.

In another embodiment, the background 360 can be set to represent a theme of the game to attract a player. As an illustration of this, the background 360 can display a sport-related image, animation or video (e.g., a football, football field, real or simulated football game action, or licensed team logo) that matches the game being presented. As another illustration, the background 360 can display an animal-related image, animation or video (e.g. a snakeskin, leopard pattern, shark teeth, real or simulated animal action) that matches the game being presented. The background 360 can display a vehicle-related image, animation or video (e.g., a car, tire tracks, or a race flag) that matches the game being presented. The background 360 can display a casino game-related image, animation or video (e.g., a playing card, deck of cards, a roulette wheel) that matches the game being presented. The background 360 can display a character-related image, animation or video (e.g., an athlete, an entertainer, a card dealer) that matches the game being presented. In all cases, such themed-backgrounds 360 can be maintained, changed or turned off once a player starts a game.

From the description above, it should now be evident that using the same layout described above in the interface 350, substantially different looking displays can be presented for different games on the same touch screen 72 for a cabinet surface 60 of the same size.

Figure 12:
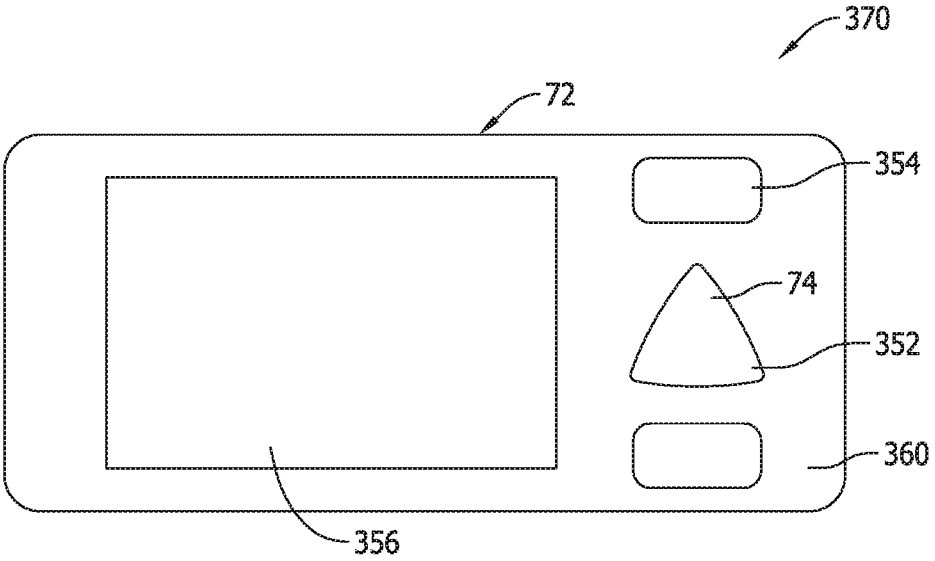
FIG. 12 is a top view of a second graphical configuration of a player interface in accordance with an embodiment of the present invention.

FIG. 12 is a top view of a second graphical configuration of a player interface 370 in accordance with an embodiment of the present invention. In the example shown, the video display 72 generates the first image 352 in the button area wherein the pushbutton 74 resides, generates a viewing window 354 of a desired size, and generates a window 356 that is considerably larger than in the interface 350. The window 358 shown in the interface 350 is omitted. The interface 370 presents a substantially different visual impression for the same or different game than the display 350.

Figure 13:
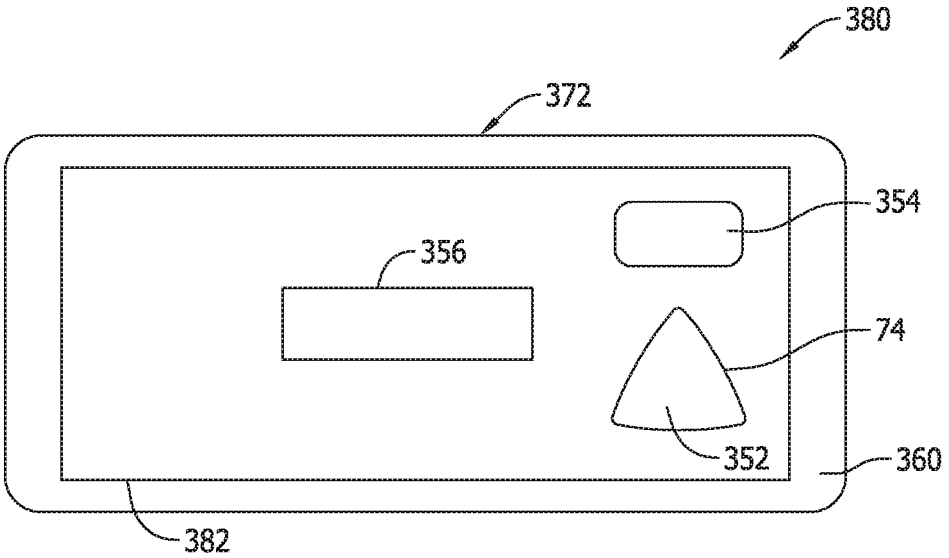
FIG. 13 is a top view of a third graphical configuration of a player interface in accordance with an embodiment of the present invention.

FIG. 13 is a top view of a third graphical configuration of a player interface 380 in accordance with an embodiment of the present invention. The interface 380 includes an arrangement of the image areas or windows 352, 354, 356 but in different proportions to provide still other visual effects. The display includes a second background 382 in combination with the first background 360. A picture-in-picture type of effect can be realized with the backgrounds 382 and 360, and or both of them can be set to appear and disappear by setting them to a color that matches the game machine cabinet. The interface 380 presents a substantially different visual impression for the same or different game than the displays 350 and 370.

Figure 14:
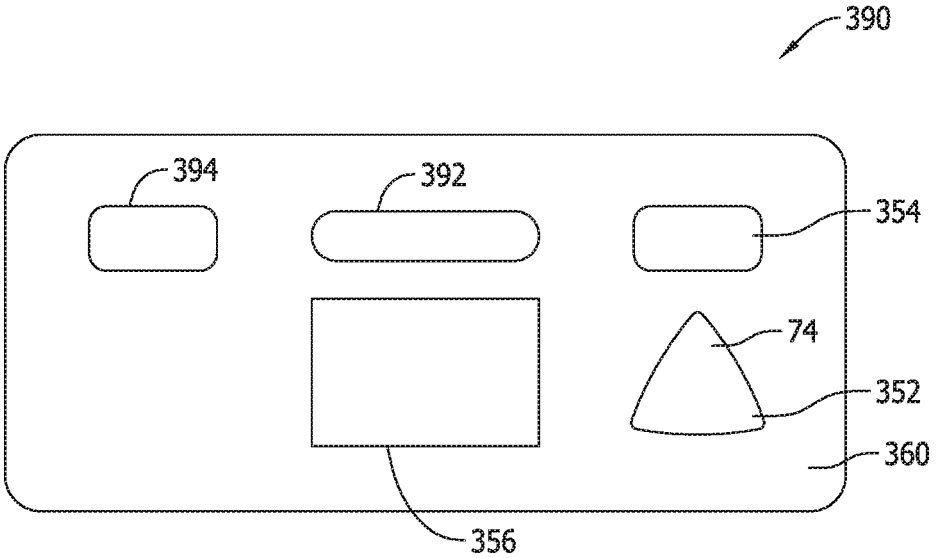
FIG. 14 is a top view of a third graphical configuration of a player interface in accordance with an embodiment of the present invention.

FIG. 14 is a top view of a third graphical configuration of a player interface 390 in accordance with an embodiment of the present invention. The interface 390 includes the image areas or windows 352, 354, 356 but in different proportions to provide still other visual effects and additional image areas or windows 392, 394 to provide still other visual effects. The interface 390 presents a substantially different visual impression for the same or different game than the display 350, 370 and 380.

As demonstrated by the examples described the dynamic pushbutton 74 and the video display 72 allows the whole button deck display area to be fully downloadable without a need to change a static label (or labels) inside the mechanical pushbutton to match different game titles. The video display 72 extends both underneath and around the pushbutton 74.

FIG. 15 is flowchart of method 400 illustrating processes executable by a controller in a gaming machine or system such as that described above including a player interface according to one of the embodiments described.

At step 402, the dynamic pushbutton assembly is provided. The assembly may be similar to that shown in FIGS. 2-4, as modified to realize a player interface portions such as those described above. The interface provided at step 402 may be mounted in a console or cabinet as described above or may be provided in another manner.

At step 404, the controller generates the desired interface on the display of the assembly provided at step 402. The interface generated includes the unique button image in the button area that is visible through the pushbutton as described above. By virtue of the unique image, the pushbutton visually stands out on the interface and is easily recognized as a pushbutton. The generation of the interface at step 404 also includes generating any viewing windows, activation areas, and background themes desired on the touch screen as described above. Accordingly, combinations of distinct button images and distinct images on the remainder of the interface are possible in electronic form (i.e., by changing the image on the display) rather than making any physical alteration or change to the machine hardware or pushbutton components, or the button deck in general.

At step 406, the controller operates the optional lighting element in the pushbutton assembly in the desired color, at desired locations around the pushbutton, and/or with desired patterns (e.g., dimming, flashing, chasing, etc.) Changes in the generated image at step 404 and the operation of the pushbutton lighting at step 406 may occur throughout a game or as desired when the game is not being played, such that the controller cycles through steps 404 and 406 as instructed.

At step 408, the game may be changed, and at step 410 the controller retrieves an interface for the new game 410 and proceeds to steps 404 and 406. The machine may be set to change games at pre-set times, and the game instructions and interfaces may be stored locally in the machine or may be accessed remotely. Alternatively, the games my downloaded from a remote database or otherwise received from a remote location.

In further embodiments, an option for a player to select a game to play is shown at step 410. Once the selection is made and accepted, the interface maybe retrieved at step 410 and the controller reverts to steps 404 and 406.

As the method 400 is executed, the interface including the dynamic pushbutton(s) is easily configured and reconfigured during the same game or to switch between different games. The configuration and reconfiguration is dynamically accomplished in electronic form and with unique lighting effects, without changing any of the machine or system hardware. Substantially different graphic themes and control functionality for any number of different games is provided with a universal dynamic pushbutton assembly as provided at step 402.

Over time, new games may be downloaded to the machine, or otherwise accessed by the machine or system, as desired, either for automatic presentation at step 408 or for selection at step 412. As such, as new games are developed they may be designed with for substantial universal use with an interface of the invention. Any need to create or maintain customized interfaces for specific games is reduced. Of course, different versions of player interfaces may be provided at step 402 if desired (e.g., interfaces having different sizes or numbers of display screens and different sizes, numbers and placements of mechanical pushbuttons), the hardware/software re-configurability still affords great benefits in accommodating different games in any given interface or to realize much more sophisticated and dynamic changes to game interfaces for a selected game as the machine is being used as well as in times of non-use.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Several embodiments are described above with reference to the drawings. These drawings illustrate certain details of specific embodiments that implement the systems and methods and programs of the present invention. However, describing the invention with drawings should not be construed as imposing on the invention any limitations associated with features shown in the drawings. It will be understood that the invention disclosed and defined in this specification extends to all alternative combinations of two or more of the individual features mentioned or evident from the text or drawings. All of these different combinations constitute various alternative aspects of the invention.

The present invention contemplates methods, systems and program products on any electronic device and/or machine-readable media suitable for accomplishing its operations. Certain embodiments of the present invention may be implemented using an existing computer processor and/or by a special purpose computer processor incorporated for this or another purpose or by a hardwired system, for example.

Embodiments within the scope of the present invention include program products comprising machine-readable media for carrying or having machine-executable instructions or data structures stored thereon. Such machine-readable media can be any available media that can be accessed by a general purpose or special purpose computer or other machine with a processor. By way of example, such machine-readable media may comprise RAM, ROM, PROM, EPROM, EEPROM, Flash, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such a connection is properly termed a machine-readable medium. Combinations of the above are also included within the scope of machine-readable media. Machine-executable instructions comprise, for example, instructions and data which cause a general purpose computer, special purpose computer, or special purpose processing machines to perform a certain function or group of functions.

In view of the description above, the programming of the controller to realize the benefits and functionality described above is believed to be within the purview of those in the art and is accordingly not further described.

In the claims which follow and in the preceding disclosure, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the disclosure.

It will be understood to persons skilled in the art of the invention that many modifications may be made without departing from the spirit and scope of the disclosure.

What is claimed is:

1. A gaming machine comprising:

a game interface comprising:

a video display having a front surface and a first outer periphery, the video display at least partly provided with an insulator and a capacitive touch sensitive element within the first outer periphery, each of the insulator and the capacitive touch sensitive element including an opening extending therethrough; and at least one mechanical pushbutton received within the opening and mounted in a spaced vertical relation from the front surface, the spaced vertical relation comprising a gap, wherein when a plunger of the pushbutton is actuated, at least a portion of the gap between the pushbutton and the front surface remains, thereby preventing contact between the plunger and the front surface, the at least one mechanical pushbutton including a top surface and a second outer periphery defining a corresponding pushbutton area within;

wherein the top surface and the pushbutton area are located entirely within the video display;

wherein the top surface is transparent; and a game controller connected to the video display and to the at least one mechanical pushbutton, the game controller configured to generate a desired display including a display portion within the pushbutton area on at least the portion of the video display, whereby the display portion is visible through the top surface.

2. The gaming machine of claim 1, further comprising a support plate, the at least one mechanical pushbutton coupled to the support plate.

3. The gaming machine of claim 2, wherein the support plate overlies the front surface of the video display.

4. The gaming machine of claim 2, further comprising at least one wire connecting the at least one mechanical pushbutton to the game controller, the at least one wire extending between the support plate and the insulator.

5. The gaming machine of claim 1, wherein the at least one mechanical pushbutton further comprises a bezel surrounding at least a portion of the second outer periphery.

6. The gaming machine of claim 5, wherein the bezel includes a lighting element.

7. The gaming machine of claim 6, wherein the lighting element is operable to display a plurality of different colors.

8. The gaming machine of claim 6, wherein the lighting element is a light emitting diode (LED) element.

9. The gaming machine of claim 1, wherein the video display is a liquid crystal display (LCD).

10. The gaming machine of claim 1, wherein the at least one mechanical pushbutton comprises a plurality of mechanical pushbuttons, the video display, and plurality of mechanical pushbuttons in combination defining a button deck on the gaming machine.

11. The gaming machine of claim 1, further comprising at least one of a coin acceptor, a credit element, or a cash out element.

12. The gaming machine of claim 1, further comprises a main screen, and the game controller responsive to the at least one mechanical pushbutton to activate a game sequence on the main screen.

13. The gaming machine of claim 1, wherein the game controller is further programmed to present, via the video display, a game interface to a player.

14. The gaming machine of claim 1, wherein at least one additional mechanical pushbutton is located to extend partly over a first portion of the video display within the first outer periphery and partly over a surface outside of the first outer periphery.

15. A method of configuring a player interface in a gaming machine system including at least one video display having an insulator, a touch sensitive element, and a front surface defining a display screen area and a mechanical pushbutton assembly entirely overlying the display screen area, the mechanical pushbutton assembly including a transparent top surface and a pushbutton area substantially smaller than the display screen area, the mechanical pushbutton assembly positioned within an opening in the touch sensitive element within the display screen area and mounted in a spaced vertical relation from the front surface, the spaced vertical relation comprising a gap, wherein when a plunger of the pushbutton is actuated, at least a portion of the gap between the pushbutton and the front surface remains, thereby preventing contact between the plunger and the front surface, the method implemented with a controller and comprising:

dynamically generating a game interface including a unique image on the display screen area that is visible through the transparent top surface and the pushbutton area of the mechanical pushbutton assembly to render the mechanical pushbutton assembly visually prominent relative to a remainder of the display screen area.

16. The method of claim 15, wherein the mechanical pushbutton assembly includes a lighting element, the method further comprising dynamically operating the lighting element in the mechanical pushbutton assembly, in combination with the unique image, to present a first game interface to a player.

17. The method of claim 16, further comprising:

retrieving one of a plurality of different game interfaces that may be presented on the player interface; and generating the unique image and operating the lighting element in the mechanical pushbutton assembly in accordance with the retrieved one of the plurality of different game interfaces.

18. The method of claim 17, further comprising:

accepting a game selection from a player.

19. The method of claim 17, further comprising presenting a second a game interface to a player upon an expiration of a predetermined amount of time.

20. The method of claim 15, wherein a second mechanical pushbutton assembly is located to extend partly over a first portion of the display screen area within a first outer periphery and partly over a surface outside of the first outer periphery.

* * * * *